US005121784A

United States Patent [19]

Lennard

[11] Patent Number: 5,121,784

[45] Date of Patent: Jun. 16, 1992

[54] LOUVERED SUNSHADE WITH CONTROLLABLE APERTURES

[76] Inventor: Paul M. Lennard, 3139 E. Almond Ave., Orange, Calif. 92669

[21] Appl. No.: 475,758

[22] Filed: Feb. 6, 1990

[51] Int. Cl.[5] ..... E06B 3/48

[52] U.S. Cl. ..... 160/130; 160/135; 160/370.2; 160/113

[58] Field of Search ..... 160/105, 370.2, 174, 160/116, 135, 130, 113; 296/97.1, 97.3, 97.8; 49/62, 61, 74, 371, 397, 169, 171

[56] References Cited

U.S. PATENT DOCUMENTS

| | | | |
|---|---|---|---|
| 1,616,297 | 2/1927 | Alber | 160/105 X |
| 2,548,512 | 4/1951 | Bergstrom | 160/174 |
| 2,624,264 | 1/1953 | Mergner | 160/105 X |
| 2,715,866 | 8/1955 | Mousel | 49/171 X |
| 2,930,650 | 3/1960 | Vosen | 296/97.3 |
| 3,083,630 | 4/1963 | Thaxton | 160/105 X |
| 3,392,654 | 7/1968 | Grenier | 49/171 X |
| 4,202,396 | 5/1980 | Levy | 296/97.8 X |

*Primary Examiner*—Blair M. Johnson
*Attorney, Agent, or Firm*—Joseph C. Andras

[57] ABSTRACT

A sunshade consisting of one or more panels for all type windows and particularly side and rear vehicle windows. The sunshade is made of a tear resistant corrugated board material with die cuts that provide a plurality of louver apertures. Die cut notches may be provided for joining and interlocking one panel to the another permitting the sunshade to be made wider or narrower. The panels may also include integral stiffening members that double as mounting support legs so that the panels stiffly traverse large areas. The aperture flaps may be individually moved to any desirable angle that prevents sun glare and blaze from penetrating the windows of a moving vehicle, but without obstructing the ambient daylight or overall vision of the occupant. When parked, the flaps may be pressed back into the die cut aperture cavities so as to provide opaque panels for full sun blockage.

15 Claims, 7 Drawing Sheets

LOUVERED SUNSHADE WITH CONTROLLABLE APERTURES

BACKGROUND OF THE INVENTION

1. Field of the Invention

The present invention relates generally to sunshades for blocking heat and glare. More particularly, this invention relates to a sunshade consisting of one or more louvered panels that may be used for all type windows but which are particularly suitable for use in side and rear motor vehicle windows.

2. Description of the Prior Art

Typical prior art sun shades are either curtains or venetian blinds that are costly to construct and must generally be permanently affixed to the window frame. The sunshade disclosed in U.S. Pat. No. 2,548,512 is a vertical blind having a costly and complicated construction that makes it unsuitable for vehicular use. A removable sun shade is disclosed in U.S. Pat. No. 4,202,396. However, because the disclosed sunshade is comprised of folding opaque rectangular sections, the sunshade must always be removed when driving and replaced when parked.

SUMMARY OF THE INVENTION

It is an object of the present invention to provide an improved sunshade that overcomes the above-mentioned disadvantages and which is suitable for use in all types of windows but in particular vehicular windows.

It is a further object of the present invention to provide a sun shade that is capable of blocking most heat, blaze and glare;

It is a further object of the present invention to provide a sun shade panel that is inexpensive to manufacture, simple to install, and may be combined with like or similar sunshade panels and/or individually trimmed to fit nearly any type, shape or size of window;

It is a further object of the present invention to provide a vehicular sun shade that does not block a vehicle occupant's horizontal vision so that the sun shade does not have to be removed while driving; and It is a further object of the present invention to provide a vehicular sun shade that does not have to be repositioned either before or after parking.

A sunshade panel according to the present invention comprises a substantially flat opaque panel; a plurality of substantially rectangular apertures in said panel; a substantially rectangular flap located in each aperture; and hinge means located between one side of each flap and one side of the respective aperture, whereby each flap is individually positionable about the hinge means on either side of a closed position, each flap being substantially identical in shape to the respective aperture whereby a friction fit exists between the flap and the respective aperture when the flap is positioned in the closed position.

The features of the present invention which are believed to be novel are set forth with particularity in the appended claims. The present invention, both as to its organization and manner of operation, together with further objects and advantages thereof, may best be understood by referencing the following description in conjunction with the accompanying drawings.

DESCRIPTION OF THE PREFERRED EMBODIMENTS

Figure 1:
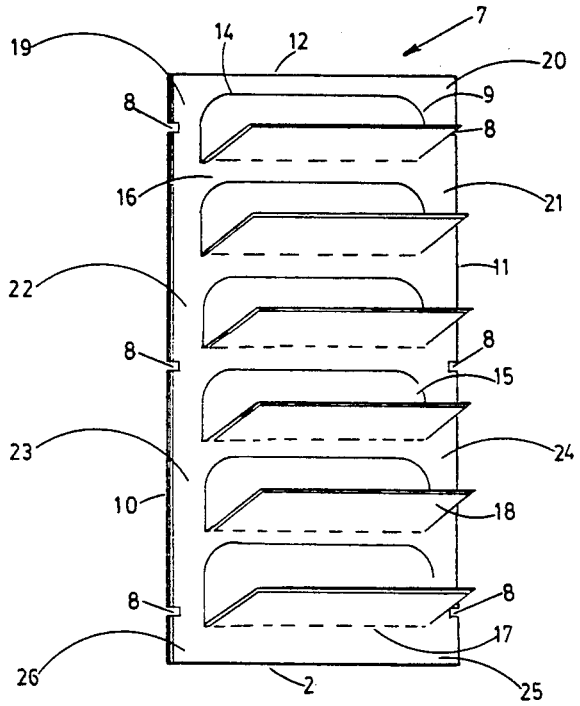
FIG. 1 is a perspective view of a first preferred embodiment of a sunshade panel according to the invention.

FIG. 1 illustrates the essential construction of a first preferred sunshade panel for use in a vehicle side or rear window. The first embodiment is comprised of a rigid but flexible substantially flat "B-flute" corrugated cardboard panel 7, having a left side 10, a right side 11, an uppermost portion 12, and a lowermost portion 2. Such a panel may also be laminated with a spunbonded olefin for added strength (not shown). The panel 7 is processed with a plurality of U-shaped die-cuts 14 and corresponding score lines 17 in order to provide a plurality of substantially rectangular apertures 15 and corresponding flaps 18. Each flap 18 is individually positionable about its respective score line 17 and may be placed in a closed position where the flap 18 is pressed into its respective aperture 15. Moreover, each flap 18 may be individually positioned to either side of the closed position.

Because each flap 18 and corresponding aperture 15 are substantially identical in shape, a friction fit beneficially exists between the flap 18 and the aperture 15 when the flap 18 is in the closed position. Each rectangular flap 18 and corresponding aperture 15 may have a pair of rounded corners 9. The rounded corners 9 serve to evenly distribute stress to all parts of each corner's radius so that the flaps are not so easily bent and damaged as the flap 18 is being pressed into or through the closed position. Moreover, the blunt large radius corners 9 also serve to minimize any potential hazard to the vehicle passengers in the unfortunate event of an accident.

Figure 2:
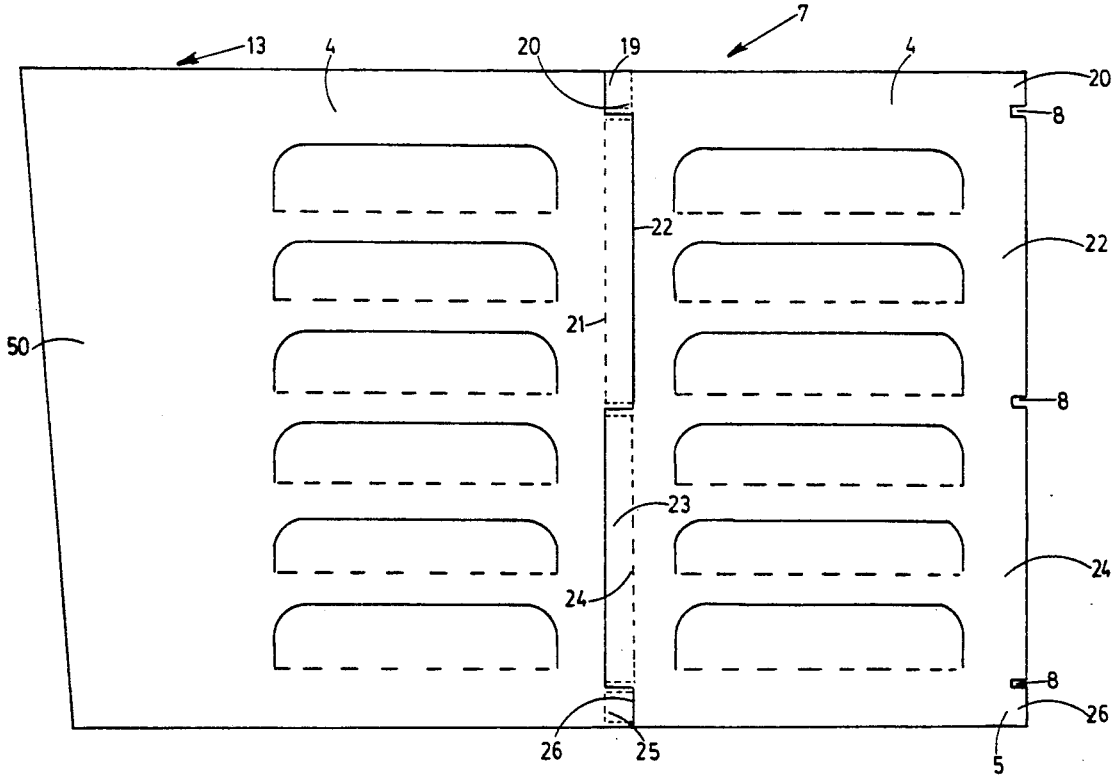
FIG. 2 is a front elevational view of a second preferred embodiment of a sunshade panel shown in combination with the sunshade panel of FIG. 1.

FIG. 2 illustrates a method of increasing the area of sun shade coverage wherein a second preferred sunshade panel 13 is joined with the sunshade panel 7 of FIG. 1 to form a two piece integral sunshade panel.

The means for joining one panel to the other is comprised of a plurality of notches 8 located on the vertical edges of each panel 7,13. The notches 8 define a plurality of adjacent vertical rectangular edge portions 20, 22, 24, 26 on the right side of each panel 7,13 and a similar plurality of edge portions 19, 21, 23, 25 on the left side of panel 7. The panels 7, 13 are fastened or interlocked to one another by joining the panels at their respective notches 8 in such a manner that the opposing rectangular edge portions of each panel alternatively overlap one another in a serpentine fashion. In particular: the lower surface of portion 19 grips the upper surface of portion 20; the upper surface of portion 21 grips the lower surface of portion 2; the lower surface of portion 23 grips the upper surface of portion 24; and the upper surface of portion 25 grips the lower surface of portion 26.

Beneficially, when the notches 8 and opposing rectangular edge portions of each panel are interlocked, they resiliently deform and stretch the internal crisscrossed B-flute corrugations (not shown) of the panels. Because the panel corrugations have a plastic memory, the slight deformation resulting from the intertwining of the edge portions causes continuous stress and tension in the material that not only helps to maintain the junction but also stiffens each of the panels.

The above described joining means also allows adjustment to accommodate different width windows. In particular, the panels 7,13 may slide back and forth relative to one another, along adjoined notches 8, so that joined panels may be made wider or narrower as desired. To provide an even further degree of adjustment, both of the panels 7,13 may be provided with excess upper portion 4,4 so that the panels are taller then the standard vehicle window. As can be seen in FIG. 2, the second preferred panel 13 is provided with an excess side portion 50 in addition to the excess upper portion 4. By using a cutting implement, such as a knife or a pair of scissors, the excess upper and/or side portions 4,4,50 may be field cut to the required shape, length or height of a window on which the sunshade panels 7,13 are to be installed.

In order to aid installation, a removable strip 54 may be formed with longitudinal die cut perforations at the outermost edge of the excess side portion 50. The strip 54 is broken off and used as a simple means of transferring the dimensions of the window to the sunshade panel in the process of trimming the sunshade panel to size. This process is set forth in detail further herein in the description with respect to FIG. 5.

Figure 3A:
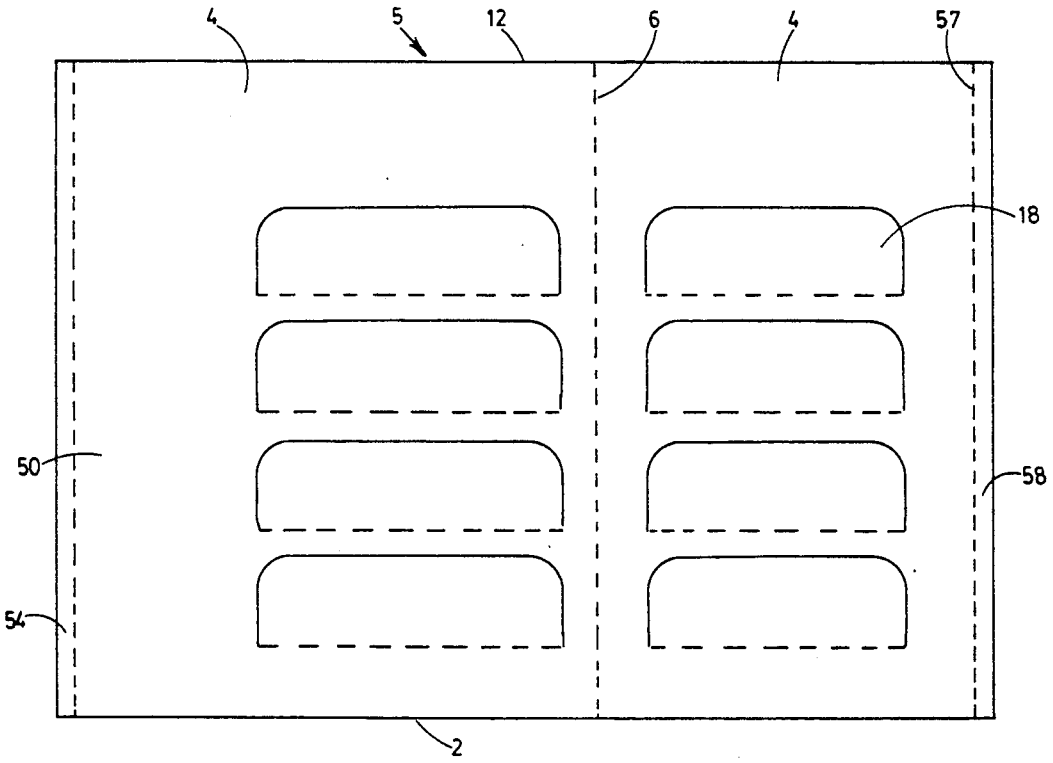
FIG. 3*a* is a front elevational view of a third preferred embodiment of a one piece sunshade panel that may be folded for storage.
Figure 3B:
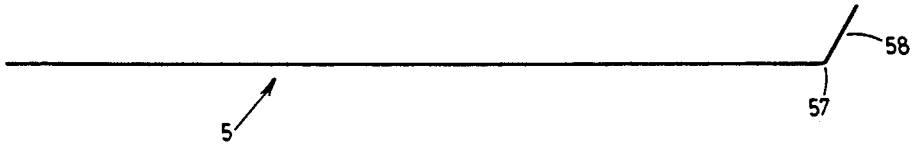
FIG. 3*b* is a top view of the sunshade panel of FIG. 3*a*.

FIGS. 3*a* and 3*b* show a one piece folding sunshade panel 5 according to a third preferred embodiment of my invention. This folding sunshade panel 5 is particularly designed for use in vehicular side windows. The folding sunshade panel 5 is essentially a double sided FIG. 1 panel 7 without notches and including a vertical score line 6 located between the plurality of flaps 18. The score line 6 permits the panel 5 to be folded for storage. If desired, a sunshade having three or more panels could of course be provided.

Like the first and second preferred panels 7 and 13, a side portion 50 and upper portions 4,4 are wider and taller then the usual vehicle window, permitting the excess dimensions 50 and 4,4 to be field cut to the required shape, length or height.

As explained above, a removable strip 54 may also be provided on the outermost edge of side portion 50 to be broken off and used during installation. In addition, the panel 5 may also include a perforated score line 57 that defines a longitudinal flange 58. The flange 58 may be folded back about the panel 5 so as to form a vertical stiffening member.

Figure 4:
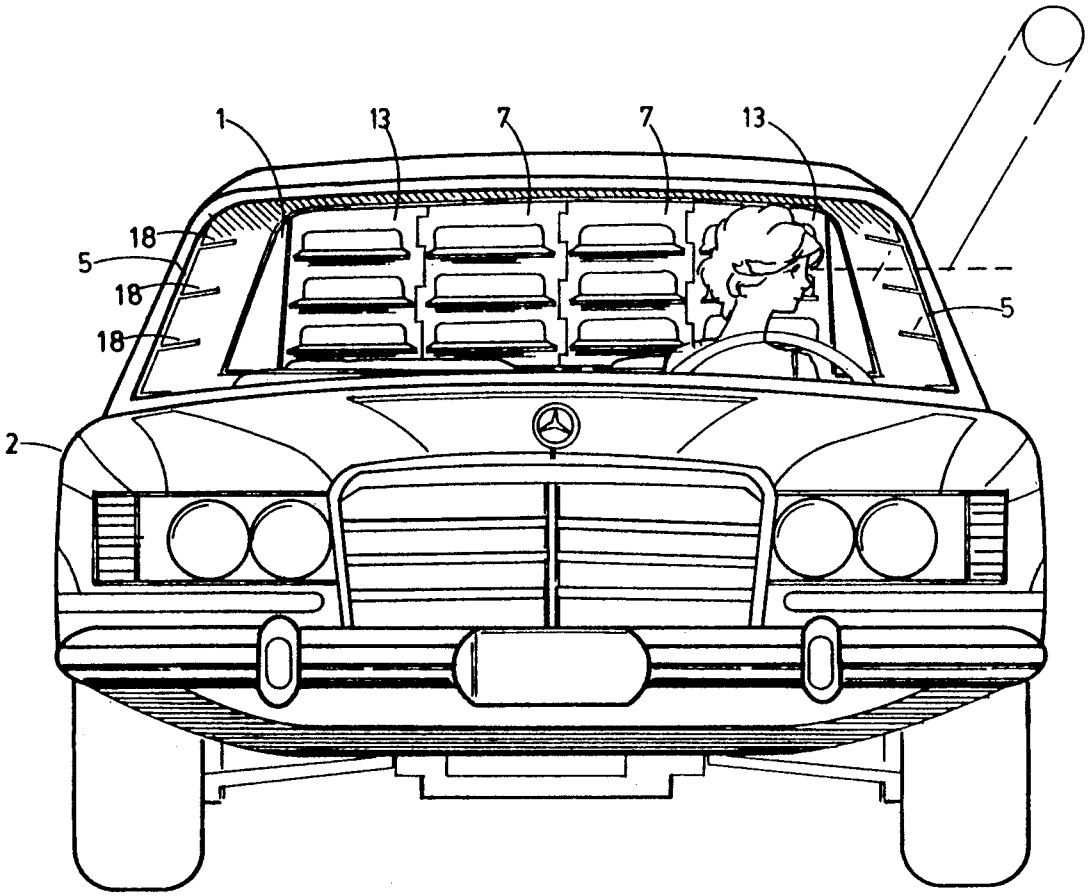
FIG. 4 is a front elevational view of an automobile with sunshade panels according to the present invention installed in the side and rear windows of the vehicle.

FIG. 4 shows a front view of a motor vehicle 2 with a folding sunshade panel 5 installed in each of the front seat side windows and a plurality of panels 13,7,7,13 installed in the rear window 1.

The flaps 18 may be individually controlled while driving and may be moved to any desired position, with the touch of a finger, to prevent and block the blaze and glare of the ever moving sun. Note that in FIG. 4 the side window sun shade flaps 18 are in a position slightly above the horizontal. In such a position, the driver (or other occupant) can scan the entire horizon with little obstruction, yet they are shielded from nearly all of the direct sunlight and blaze and ambient light can still enter the car.

FIG. 4 also shows a plurality of panels 13,7,7,13 that have been trimmed to size to fit the rear view window 1. These panels, like the sunshade panels 5 in the side windows, block the glare of the sun while still permitting the driver to have a substantially unobstructed view of the entire horizon.

The louvered panels 7,13,5 installed in the vehicle do not have to be removed to drive the vehicle, nor do they have to be repositioned every time the vehicle is parked. However, if total shielding is desired when parked, the flaps 18 may be closed with the push of a finger.

Figure 5:
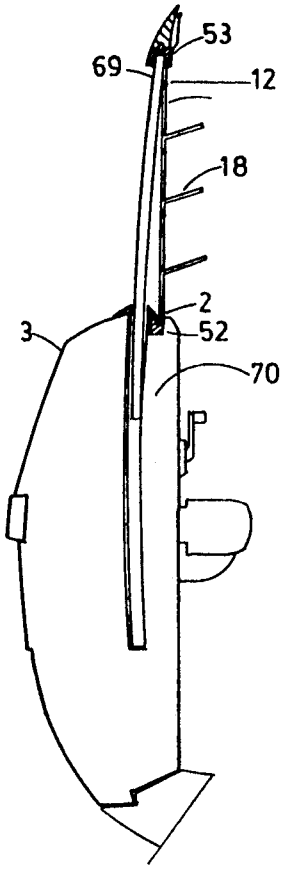
FIG. 5 is a sectional view of a vehicular side door that shows how a sunshade panel may be installed over the door window.

FIG. 5 is a sectional view of a vehicular front side door 3 showing a third preferred panel 5 installed adjacent to the glass 69. A description of the preferred installation process will now be undertaken with reference to FIG. 5.

The removable installation strip 54 that accompanies the panel 5 is broken off and used to determine the height of the window 69 by placing the strip 54 between the lower seal 52 and the upper seal 53. The height of the window is recorded by marking the strip, bending the strip, or by cutting off the excess length. The strip 54 is then placed against the panel 5 so that the excess upper portion 4 of the panel may be trimmed to fit the vertical dimension of the window.

The trimmed panel may then be installed adjacent to the window 69 in the following manner: first, the window 69 is partially rolled down (not shown); second, the longitudinal strip 58 is folded back about the panel 5 along perforated score line 57 (see FIGS. 3(a) and 3(b)); third, the folded back strip 58 and the entire lowermost portion 2 of the panel 5 are together pressed into the cavity space between the lower seal 52 and the inner door panel 70; fourth, the uppermost portion 12 and the folded back strip 58 are placed on the outer side of the upper window seal 53; finally, the window 69 is rolled up, trapping the uppermost portion 12 and the folded back strip 58 between the window 69 and the upper window seal 53. The folded back strip 58 serves as a vertical stiffening member. In addition, because the panel material has a plastic memory, the folded back strip 58 pushes against the upper window seal 53 and the inner door panel 70 so that the panel 5 is biased towards the glass 69. Panels 7 and 13 may be similarly installed.

Figure 6:
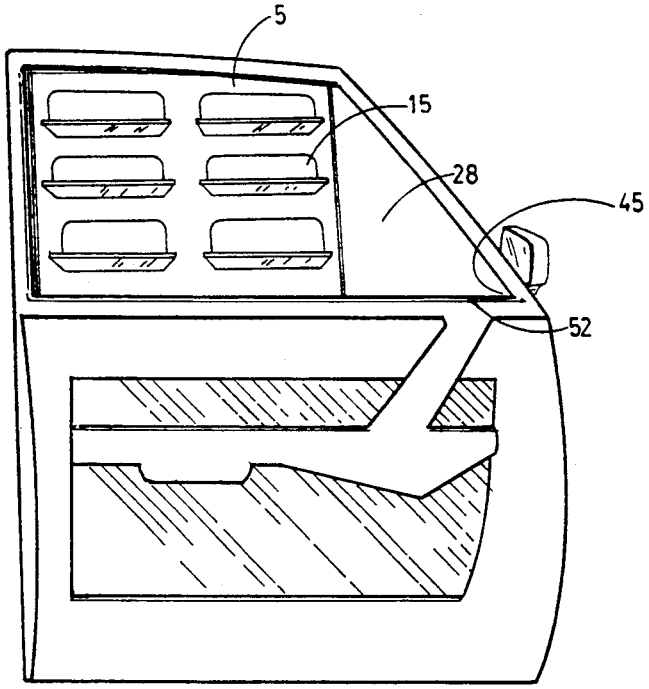
FIG. 6 is an inside elevational view of a vehicular front side door with the third preferred sunshade panel of FIG. 3*a* installed over the door window, the forward portion of the window being uncovered.

FIG. 6 is an inside elevational view showing a third preferred panel 5 installed in a vehicular front seat side door with the forward portion of the window being uncovered. Because all vehicle seats are approximately at the same distance between the lower window seal 52, the apertures 15 are invariably located at a height where nearly all drivers, regardless of their seat position (FIG. 4), can easily see through the louvered apertures 15.

Figure 7:
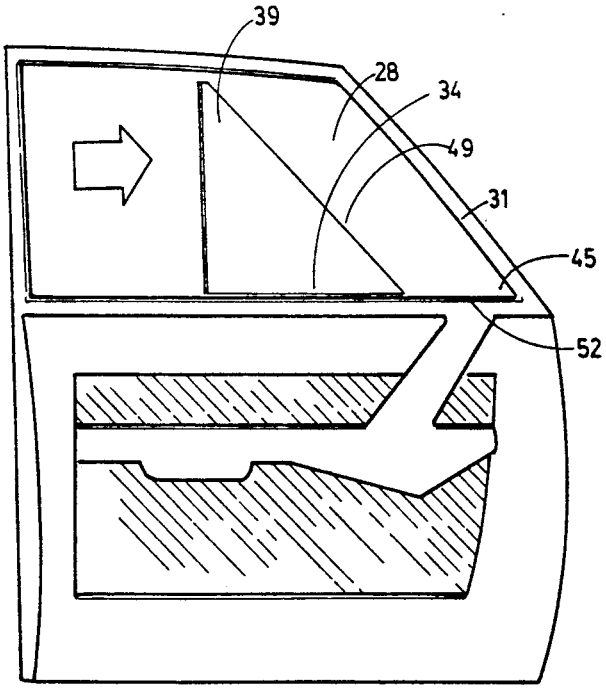
FIG. 7 is an inside elevation view of a vehicular front side door showing an opaque triangular panel according to the present invention, the opaque panel being used to cover the uncovered forward portion of the window shown in FIG. 6.

When driving, the triangular window area 28 would usually not have any sort of cover or panel installed therein. Such coverage may however be desirable when parked. FIG. 7 shows how a substantially triangular panel 39 may be placed in the usually uncovered front window area 28 to block out sun when the vehicle is parked. The triangular panel 39 may be constructed of any suitable opaque material and, in a preferred embodiment, from the same material comprising panels 5, 7 and 13. The installation of the opaque triangular panel is very simple. The lower portion 34 of triangular panel 39 is pushed toward the angled window seal 31. As the panel 39 is pushed towards the corner 45, the triangular panel 39 becomes wedged between the angled portion 31 of the window seal and the lower margin 52 of the window so as to be tightly fixed in the bare window area 28.

Figure 8:
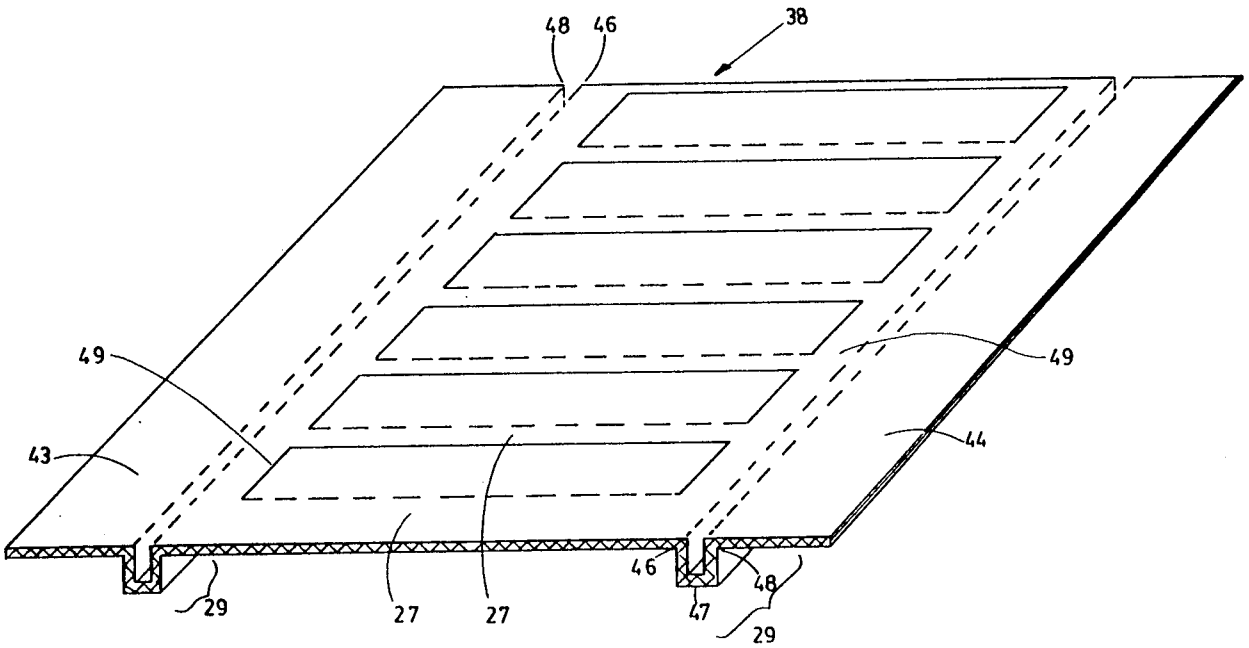
FIG. 8 is a perspective view of a fourth preferred embodiment of a sunshade panel that includes both horizontal and vertical strengthening ribs and further includes side flanges that may overlap similar flanges on other sunshade panels.

FIG. 8 illustrates a third embodiment comprised of a panel 38 having horizontal strengthening ribs 27, first vertical strengthening ribs 49, and second vertical strengthening ribs 29 that form an integral part of panel 38. The strengthening ribs 29 protrude at a substantially normal angle from the panel 38 and are formed from a plurality of bends along first and second longitudinal score lines 46,48. More specifically, each vertical strengthening member 29 is comprised of a first substantially 90 degree bend 46, a 180 degree bend 47, and a second 90 degree bend 48, whereby an end view of the individual vertical strengthening members 29 look like the letter "T". A pair of rectangular side flange sections 43,44 are formed from the material that extends beyond the vertical strengthening members 29. The side flange section 43,44 may beneficially pivot along the second longitudinal score lines 48.

Figure 9:
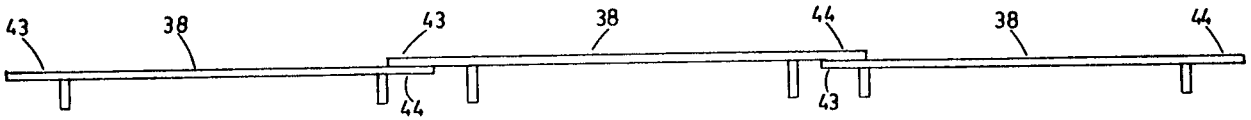
FIG. 9 is an end view of three FIG. 8 panels showing how the side flanges of the individual panels may overlap one another in order to increase or decrease the amount of sunshade coverage.

As shown in FIG. 9, multiple panels 38 may be placed adjacent to one another by laying a first panels flange 43 overlappingly on either side of a second panels flange 44. Furthermore, when multiple FIG. 8 panels are arranged as shown in FIG. 9, the overall area of sunshade coverage may be adjusted by varying the extent to which the side flanges 43,44 of adjacent panels 38 overlap one another. The degree of overlap may be adjusted to increase or decrease the width of the multiple joined panels in order to accommodate variable size windows.

Figure 10:
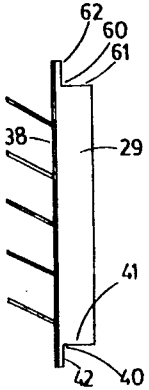
FIG. 10 is a side elevational view of a FIG. 8 sunshade panel showing horizontal and vertical support ridges that are used for mounting the sunshade panel within or on a window frame, the support ridges being cut from the strengthening ribs.

FIG. 10 is a side view of the FIG. 8 panel 38 illustrating support ridges 41,42, 61,62 that are formed by making a pair of L-shaped cut outs 40,60 in the strengthening ribs 29. The lower L-shaped cut out 40 would ordinarily be die cut at the factory. The upper L-shaped cut out 60 would ordinarily be field cut after the panel 38 has been trimmed to fit within the vertical dimensions of the window frame.

The ridges labelled 42 and 62 are horizontal support ridges for use with horizontal windows such as vehicular "hatch back" windows. The ridges labelled 41 and 61 are vertical support ridges for use with vertical windows such as ordinary residential windows having a lower and upper margin. The upper vertical support ridge 61 would ordinarily not bear any load.

Figure 11:
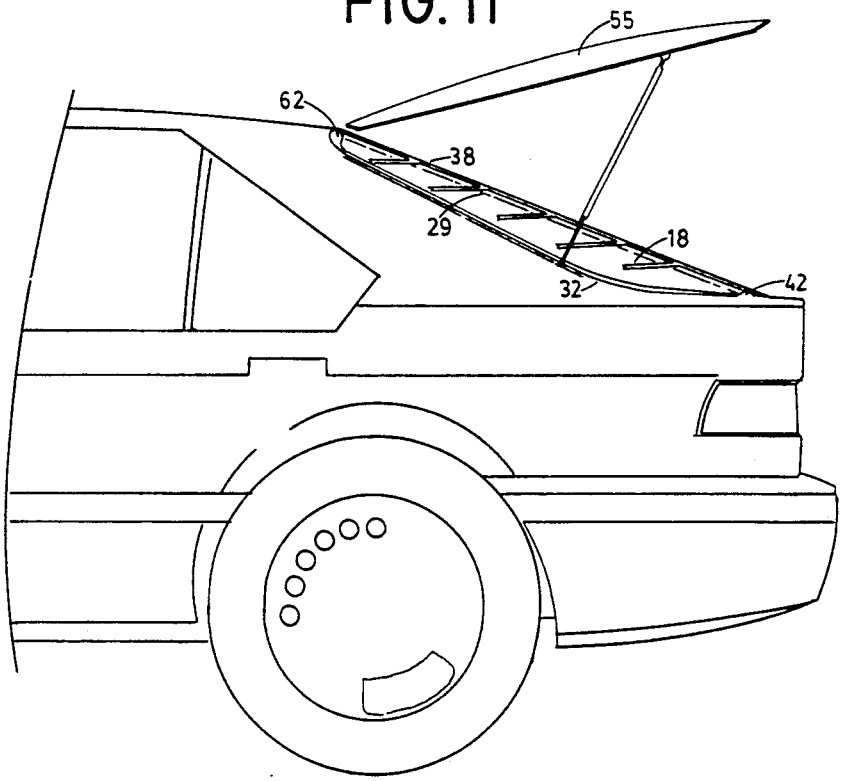
FIG. 11 is a side elevational view of a hatch-back vehicle showing how a FIG. 8 panel is installed therein by resting the support ridges on the hatch-back "O" ring before closing the hatch-back window.
Figure 12:
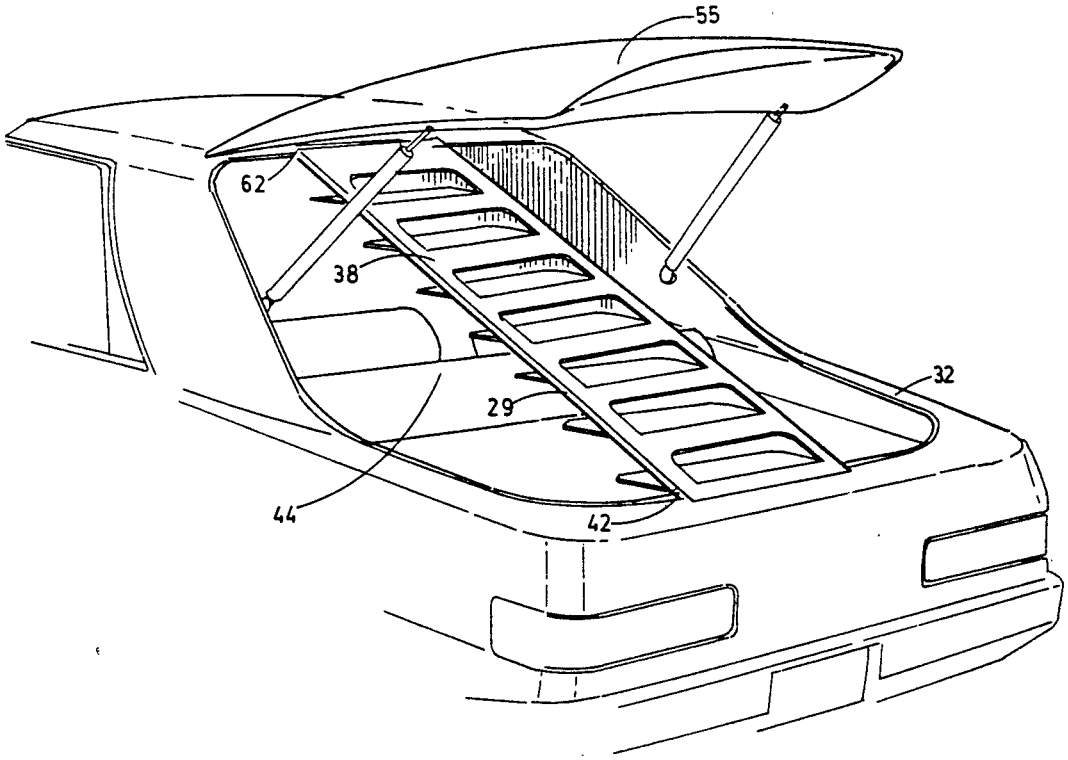
FIG. 12 is a perspective view of FIG. 11.

FIGS. 11 and 12 are a side view and a perspective view, respectively, of a FIG. 8 panel 38 installed on a "hatch back" vehicle. The flaps 18 are shown in a downward horizontal position that blocks direct sunlight but still allows the occupants to see out. The horizontal support ridges 42,62 are rested on the "O" ring gasket 32 before the "hatch back" window 55 is closed so that the panel 38 is locked between the gasket 32 and the "hatch back" window 55.

As shown in FIGS. 11 and 12, the strengthening ribs 29 help support the panel stiffly span the open area 44, with the upper and lower support ridges 42,62 resting on the "O" ring gasket 32. As suggested by FIG. 9, additional panels 38 can be positioned on either side of the illustrated panel 38 to cover the entire area 44.

Figure 13:
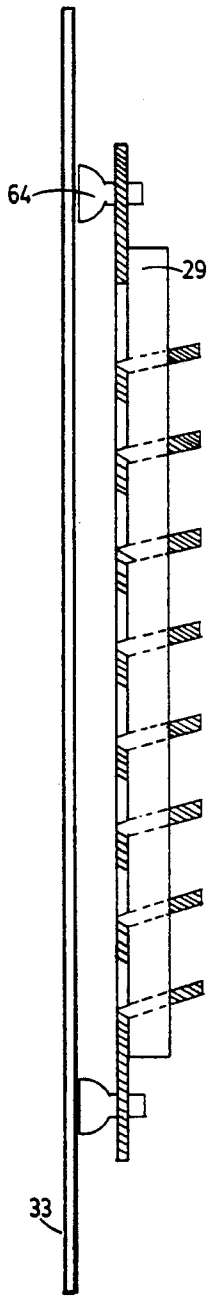
FIG. 13 is a side cutaway view of a FIG. 8 sunshade panel wherein suction cups are used to mount the sunshade panel directly on window.

FIG. 13 shows a sectional side view of a panel 38 that employs suction cups 64 as a means for fastening the panel directly to a window. For example, rather than resting the panel on the hatch back window O-rings, the panel 38 could be attached directly to the glass of "hatch back" window 55 by suction cups 64. Any of the panels disclosed herein may also be attached on to any horizontal or vertical window 33 in any position with suction cups 64.

Figure 14:
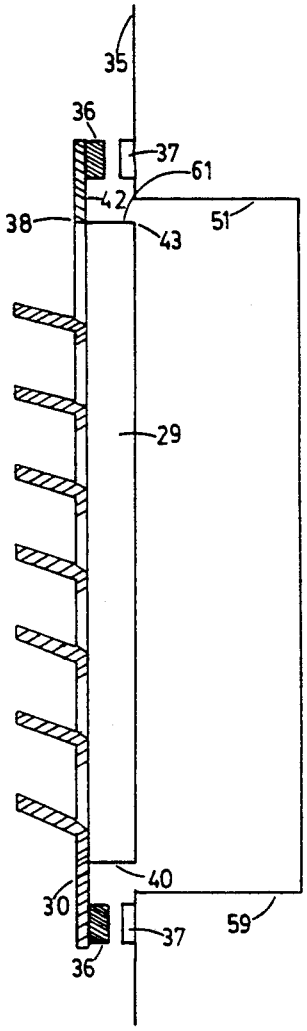
FIG. 14 is a side cutaway view of a FIG. 8 sunshade panel wherein magnetic strips are used to mount the sunshade panel to a residential window frame.

FIG. 14 shows a sectional side view of a panel 38 that has been attached to a window frame 35 by using magnetic strips 36 in conjunction with metallic strips 37. The lower vertical support ridge 41 rests on the upper surface of the window sill 59 while the upper vertical support ridge 61 fits under the upper window sill 51. The magnetic strips 36 may be adhesively joined to the upper and lower portions of panel 38 such that the panel 38 and magnetic strip 36 may magnetically adhere to the facing metal surface 37. It is readily apparent that any of the panels disclosed herein may be attached to any ferrous surface in any position with joined magnetic strips.

Figure 15:
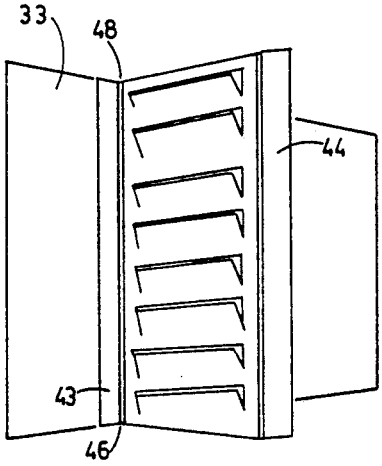
FIG. 15 is a perspective view of a FIG. 8 sunshade panel and illustrates how the sunshade panel may be swung away from a window by rotating a majority of the panel along a vertical score line and relative to one of its flanges that remains stationary.

FIG. 15 illustrates a feature of a FIG. 8 panel 38 when either side flange 43 or 44 have been adhesively or magnetically attached to a wall or window surface 33. The longitudinal score lines 46,48 (see FIG. 8) provide the panel 38 with a swinging hinge action whereby a majority of the panel 38 may temporarily swing away from the window 33 about the longitudinal score lines. The upper and lower portions may be magnetically attached to the upper and lower parts of a window sill as shown in FIG. 14.

Any of the herein disclosed sunshades can be easily painted to match the vehicle or environment in which the panel is used. Moreover, the sunshades can also be printed with advertising or decorated with any variety of pictures or slogans.

While the above features of the present invention teach the construction, configuration and application for improved sunshades, it can be readily appreciated that it would be possible to deviate from the above embodiments of the present invention and, as will be readily understood by those skilled in the art, the invention is capable of many modifications and improvements within the scope thereof. Accordingly, it will be understood that the invention is not limited by the specific embodiments but only by the spirit and scope of the appended claims.

I claim:

1. A sunshade comprising:

a substantially flat opaque panel;

a plurality of substantially rectangular apertures in said panel;

a substantially rectangular flap located in each aperture;

two or more first vertical strengthening ribs being defined by sections of the panel located on the left and right sides of each flap;

two or more second vertical strengthening ribs located on the left and right sides of each flap and protruding from the panel at a substantially normal angle relative thereto; and hinge means located between one side of each flap and one side of the respective aperture, each flap being individually positionable about the hinge means on either side of a closed position, each flap being substantially identical in shape to the respective aperture, a friction fit existing between the flap and the respective aperture when the flap is positioned in the closed position.

2. The sunshade of claim 1 wherein a first and second corner of each substantially rectangular aperture and each substantially rectangular flap have round radius edges, the first and second corners being those corners that are located on the side opposite to the side where the hinge means is located.

3. The sunshade of claim 1 further comprising means for joining one panel to another whereby the area of sunshade coverage may be increased.

4. The sunshade of claim 3 wherein the means for joining is comprised of a plurality of notches at the edge of each panel, the notches defining a plurality of adjacent edge portions on each panel, whereby the panels may be fastened to one another by joining the panels at the notches in such a manner that the edge portions of each panel oppose each other and so that the adjacent edge portions of each panel are alternatively on opposite sides of an opposing edge portion in a serpentine fashion.

5. The sunshade of claim 1 wherein the substantially flat opaque panel is comprised of cardboard.

6. The sunshade of claim 5 wherein the cardboard panel is laminated with spunbonded olefin for added strength.

7. The sunshade of claim 1 wherein the apertures and flaps are defined by a substantially rectangular U-shaped incision in said panel, and wherein the hinge means is comprised of a linear depression located in that portion of each panel that lies between the open ends of each U-shaped incision.

8. A sunshade comprising:

a substantially flat opaque panel;

a plurality of flaps cut from said panel, each flap being defined by a substantially rectangular U-shaped incision in said panel, that portion of each panel that lies between the open ends of each U-shaped incision being scored so as to form a hinge line whereby each flap is individually positionable about the hinge line; and means for joining one panel to another whereby the area of sunshade coverage may be increased, said means for joining being comprised of a plurality of notches at the edge of each panel, the notches defining a plurality of adjacent edge portions on each panel, whereby the panels may be fastened to one another by joining the panels at the notches in such a manner that the edge portions of each panel oppose each other and so that the adjacent edge portions of each panel are alternatively on opposite sides of an opposing edge portion in a serpentine fashion.

9. The sunshade of claim 8 wherein the substantially rectangular U-shaped incision defining each flap has round radius corners.

10. The sunshade of claim 8 wherein the substantially flat opaque panel is comprised of cardboard.

11. The sunshade of claim 10 wherein the cardboard panel is laminated with spunbonded olefin for added strength.

12. An improved sunshade, in combination with a building window having an upper margin, a lower margin, a left margin, and a right margin, the improved sunshade comprising:

a rigid but flexible substantially flat panel having a left side, a right side, an upper-most portion, a central portion and a lower-most portion;

a plurality of substantially rectangular flaps being defined in the central portion of said panel by a plurality of substantially rectangular U-shaped incisions, that portion of each panel that lies between the open ends of each U-shaped incision being scored so as to form a hinge line whereby each flap is individually positionable about the hinge line;

two or more horizontal strengthening ribs being defined by sections of the panel located above and below each flap;

two or more first vertical strengthening ribs being defined by sections of the panel located on the left and right sides of each flap; and two or more second vertical strengthening ribs formed from portions of the panel and protruding at a substantially normal angle from the panel;

means for attaching the upper-most portion, the lower-most portion, the left side, and the right side of the panel to the respective the upper, lower, left, and right margins of said window.

13. The sunshade of claim 12 wherein the substantially rectangular U-shaped incision defining each flap has round radius corners.

14. The improved sunshade of claim 12 wherein the second vertical strengthening ribs are defined by a plurality of bends that extend along the vertical length of the panel, the plurality of bends that corresponds to each second vertical strengthening member including a first substantially 90 degree bend, a 180 degree bend, and a second 90 degree bend, whereby a cross-section of the second vertical strengthening member looks like the letter "T".

15. The sunshade of claim 12 further comprising means for joining one panel to another whereby the area of sunshade coverage may be increased.

* * * * *